United States Patent [19]

Forslund et al.

[11] Patent Number: 4,523,894

[45] Date of Patent: Jun. 18, 1985

[54] EJECTOR PUMP WITH RINGSHAPED NOZZLE

[75] Inventors: Lennart Forslund, Upsala; Örjan Nilsson, Solna, both of Sweden

[73] Assignee: Svenska Rotor Maskiner Aktiebolag, Nacka, Sweden

[21] Appl. No.: 616,556

[22] Filed: Jun. 1, 1984

[30] Foreign Application Priority Data

Jun. 3, 1983 [SE] Sweden ..... 8303162

[51] Int. Cl.[3] ..... F04F 5/00

[52] U.S. Cl. ..... 417/161; 417/196

[58] Field of Search ..... 417/161, 196, 198, 151

[56] References Cited

U.S. PATENT DOCUMENTS

| | | | |
|---|---|---|---|
| 1,296,567 | 3/1919 | Suczek | 417/161 |
| 1,344,967 | 6/1920 | Suczek | 417/161 X |
| 1,563,752 | 12/1925 | Kothny | 417/161 |
| 1,661,960 | 4/1927 | Riehl . | |
| 3,188,976 | 6/1965 | Dodge | 417/161 |

*Primary Examiner*—Edward K. Look

*Attorney, Agent, or Firm*—Frishauf, Holtz, Goodman & Woodward

[57] ABSTRACT

An ejector pump has a ringshaped nozzle slot directed radially outwards followed by a radially directed mixing zone interacting with a secondary channel and a radially directed diffuser slot.

To achieve an improved performance, and especially one having a characteristic less dependent to decreases of working medium pressure the ejector pump is comprised of two mutually fixed blocks (1, 2) having each an end surface (4, 6). Said end surfaces (4, 6) are facing each other forming an annular slot (12). The surfaces of the nozzle slot and the diffuser slot are profiled in at least one of said end surfaces (6) separated by an annular groove (7) in said end surface, which groove (7) communicates with the secondary channel. The diffuser slot height adjacent the groove (7) is larger than the nozzle slot height ($h_o$) adjacent said groove decreasing outwardly by the way of at least two bevels, first one having an angle of bevel $\alpha_1 = 8°-15°$ and then one having an angle of bevel $= 4°-8°$, the ratio $\alpha_1/\alpha_2$ amounting to 1.25–3.25 and each bevel $\alpha_2$ having a width of at least 0.5 times the smallest width of the groove followed by an annular slot portion height ($h_1$) amounting to 0.84–0.97 times the nozzle slot height ($h_o$) adjacent the groove (7) along a distance of at least 0.8 times the smallest width of the groove (7) beginning at a distance of at most 4.9 times the smallest width of the groove from the outermost edge of nozzle (21).

4 Claims, 4 Drawing Figures

EJECTOR PUMP WITH RINGSHAPED NOZZLE

BACKGROUND OF THE INVENTION

The present invention relates to an ejector pump including an annular nozzle slot for a pumping medium directed mainly radially outwards, an annular mixing zone situated radially outside said nozzle zone, in which mixing slot an outlet opening of at least one mainly axially directed secondary channel is situated and an annular diffuser slot situated radially outside said mixing zone.

Ejector pumps of this kind have been developed, during a long period of time, into relatively small and dependable pumps with high efficiency.

Ejector pumps of this kind have come into use especially as vacuum pumps for 50% vacuum and more, especially around 85% vacuum.

A disadvantage is, however, that they are complicated to produce. A plurality of parts have to be precision manufactured and then assembled with very small tolerances as to mutual positions as well as angular accuracies in order to achieve an ejector pump with desired characteristics. When discrepancies occur, corrections can be made by adjusting adjustable parts. This, however, requires manual work which will increase the cost of manufacturing.

Another disadvantage is that the high efficiency of ejector pumps is highly dependent on a certain, narrowly delimited pressure value. On each side of this pressure value the characteristics of the pump will be rapidly deteriorated, which is inconvenient with respect to the fact that the pressure rate in compressed air plants, in workshops, factories etc, often varies many decades of percent up and down.

The object of this invention is to achieve an improved ejector pump in which the above disadvantages are eliminated totally or to a great extent. This has been obtained, according to the invention, by giving the ejector pump the characteristic features stated in the accompanying claims.

SUMMARY OF THE INVENTION

According to the present invention, all essential parts, like the nozzle, slot, the mixing zone and the diffuser slot are shaped in one or both end surfaces of the integral blocks. The shaping can be carried out in one single operation in a numerically controlled turning lathe, thereby enabling great precision and good reproduction properties to be obtained in manufacturing a large number of pumps. Since the pump of the present invention does not contain any parts that need to be adjustable for compensating discrepancies as to properties of the pump when assembled, which is the case in connection with conventional pumps consisting of several parts, there is no risk for mutual displacements of different parts of the pump after actual operation for a time, leading to fluctuations of the properties of the pump. The profile of the nozzle and diffuser slots is clearly and exactly engraved in an end surface, that will be entirely exposed when the two blocks of the pump are separated, and which engraved surface includes a number of bevels, which easily can be controlled by measuring their discrete angles and positions along a diagonally orientated reference line.

The invention is described in detail in the following with reference to the accompanying drawings which schematically show an embodiment of an ejector pump according to the invention.

DETAILED DESCRIPTION

Figure 1:
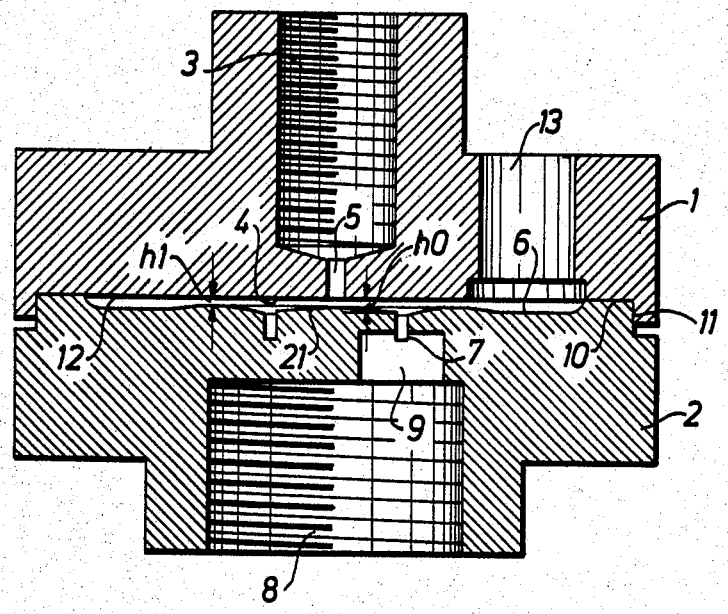
FIG. 1 is a longitudinal cross sectional view of the pump.

Referring to FIG. 1 the ejector pump of the invention comprises two cylindrical pieces, one overpressure block 1 and one underpressure block 2 joined by screws, not shown. Block 1 has a central channel 3 which is intended to be joined to a source of pressurized air, said channel 3 terminating as a fine (i.e. narrower) channel 5 at the plane end surface 4 of block 1. Block 2 has an end surface 6, corresponding to end surface 4, which is profiled and has a ringshaped groove 7 formed therein. Groove 7 is coaxial with channel 5 and encircles a bevelled nozzle surface 21.

In block 2 there is a cavity 8 intended for connection to a vacuum pipe. In the bottom of the cavity 8 some bores 9 are made for connecting the cavity 8 to the ringshaped groove 7.

In order to mutually orientate the blocks 1 and 2 radially and axially, block 2 has a ringshaped projection or rib 10 that, with small fitting allowance, is encircled by a projection 11 that extends around the circumference of block 1. Projection 11 is somewhat lower than projection 10. The end surface of projection 10 is machined with great accuracy because the end surface of projection 10 fits-up against the plane end surface 4 of block 1 and thereby sets the height of the annular slot 12 that is formed between the end surfaces 4 and 6. Along said annular slot 12 there are a number of axially directed outlet channels 13 arranged in block 1.

Figure 2:
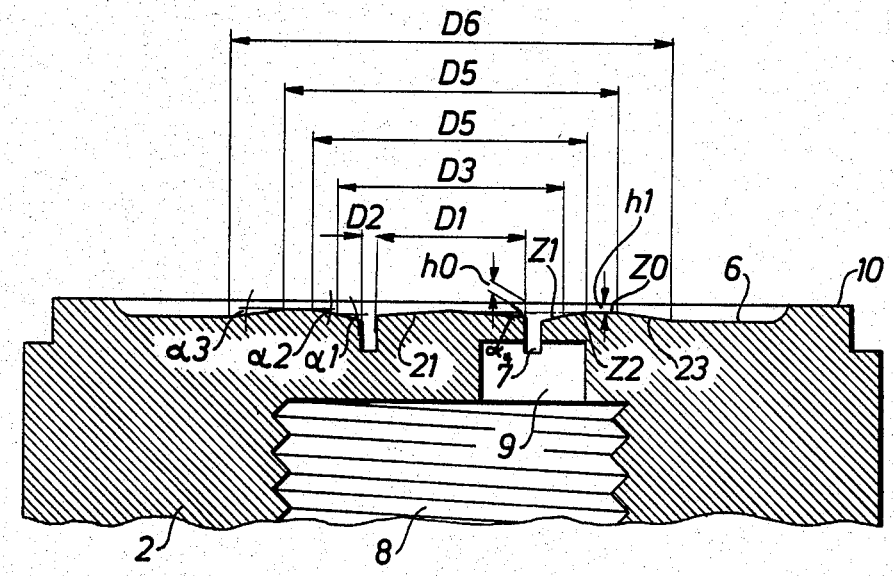
FIG. 2 is a similar sectional view of one of the blocks of the pump, but on an enlarged scale.

Referring to FIG. 2 this figure shows, on an enlarged scale, the profile of the end surface 6. The circular center part 21 with an angle of bevel $\alpha_4$ ringshaped groove 7 has a diameter $D_1$ and the groove 7 has a width $D_2$. Outside the groove 7 the end surface 6 has a bevelled zone $Z_1$ with an angle of bevel $\alpha_1$, after that from diameter $D_3$ a bevelled zone $Z_2$ with an angle of bevel $\alpha_2$, from diameter $D_4$ a non-bevelled zone $Z_0$, and finally from diameter $D_5$ a bevelled zone $Z_3$ with an angle of bevel $\alpha_3$. Bevel zone $Z_3$ ends at diameter $D_6$. There are two dimensions that are of extreme importance which have a tolerance of $\pm 1/100$ mm; those are the slot height $h_0$ at the periphery of the center part 21 and the slot height $h_1$ at the zone $Z_0$.

The following table shows two suitable designs of ejector pumps according to the invention having symbols according to FIG. 2 ($h_1$-$D_6$ in mm).

| | $h_1$ | $h_0$ | $D_1$ | $D_2$ | $D_3$ | $D_4$ | $D_5$ | $D_6$ | $\alpha_1$ | $\alpha_2$ | $\alpha_3$ |
|---|---|---|---|---|---|---|---|---|---|---|---|
| I | 0.23 | 0.25 | 7.0 | 0.75 | 10 | 12 | 14 | 20 | 15° | 8° | 5° |
| II | 0.27 | 0.30 | 8.0 | 1.0 | 13 | 16 | 18 | 25 | 10° | 6° | 5° |

Figure 3:
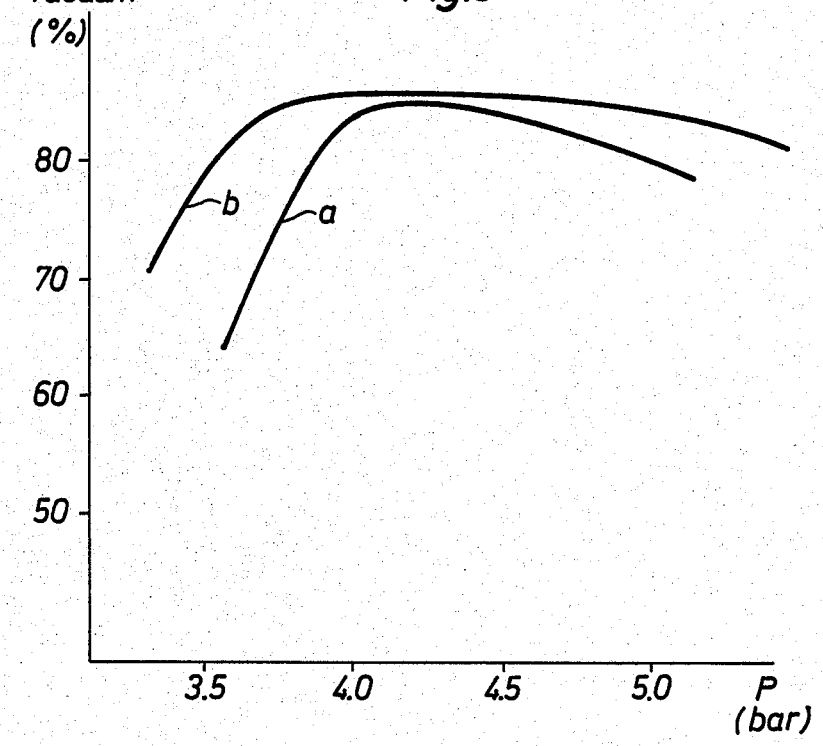
FIG. 3 is a diagram showing the vacuum obtained at different pressures on the working medium for a conventional pump and for a pump according to the invention.

FIG. 3 shows a curve a indicating the rate of vacuum, in percent, that is obtained by a conventional ejector pump at different working medium pressures.

As seen in the diagram, of FIG. 3 curve a shows that the vacuum declines rapidly as soon as the working medium pressure is changed from the optimal pressure, especially when the pressure is decreased.

A considerably higher vacuum is obtained, especially at low pressures of the working medium. Curve b in FIG. 3 corresponds to the present invention.

Figure 4:
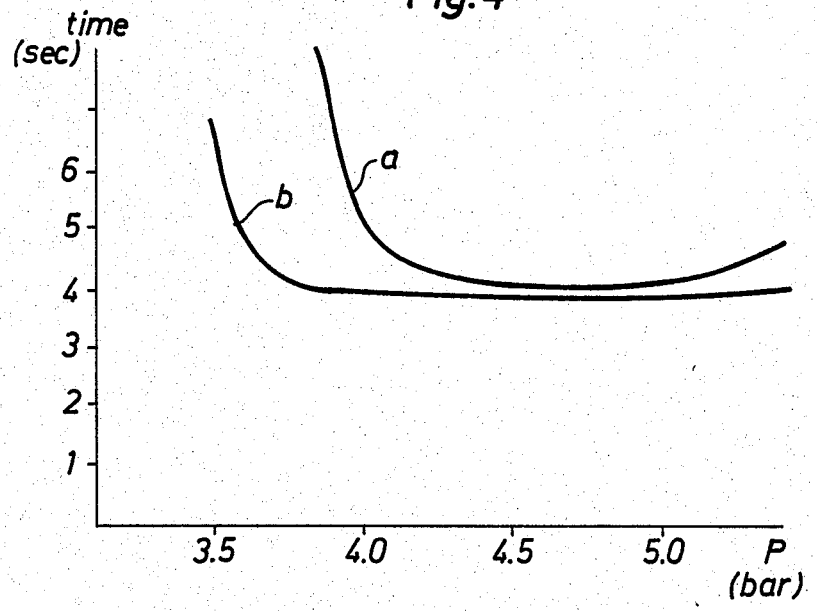
FIG. 4 is a diagram showing the time required for obtaining a certain rate of vacuum in a closed vessel for a conventional pump and for a pump according to the invention.

FIG. 4 shows a curve a indicating the time required for a conventional ejector pump to obtain 75% vacuum in a closed vessel of 10 liters. The time required increases rapidly with decreasing pressures of the working medium.

FIG. 4 also shows the corresponding curve b for an ejector pump designed according to the invention. From FIG. 4 it is obvious that a considerable improvement is obtained at lower working medium pressure.

The invention is not limited to the embodiments shown and described, but can be modified in several ways within the scope of the invention defined by the claims. Thus, also the end surface 4 of block 1 can be profiled in the same manner as end surface 6 of block 2 and designed with a ringshaped groove and cavities or channels corresponding to the cavity 8 and the bores 9 in block 2 and connected to a vacuum line. The advantage of this is normally not in reasonable proportion to the increased difficulties of manufacturing.

In some cases it can be convenient to arrange the outlet channels 13 in block 2 or directed radially outwards in both blocks.

Alternatively the working medium can be supplied through a pipe that terminates in an axially directed channel in the center of the end surface 6, i.e. in the center of the surface 21 in FIG. 2. Further, the ringshaped groove 7 can be made convergent and/or directed sloping outwards as seen in the flow direction in which way some flow losses can be reduced.

We claim:

1. In an ejector pump including two opposed integral blocks, each having end surfaces and defining between said end surfaces an annular nozzle slot for a pumping mediu, said nozzle slot being directed mainly radially outwards; an annular mixing zone situated radially outside said nozzle slot; an outlet opening in said mixing zone in at least one of said blocks, said outlet opening including at least one mainly axially directed secondary channel in communication with said mixing zone; and an annular diffuser slot situated radially outside said mixing zone; the nozzle slot, the mixing zone and the diffuser slot being defined by an interspace (12) between end surfaces (4, 6) of said two integral blocks (1, 2) separated by spacer means (10), the improvement wherein:

portions of at least one of said end surfaces (6) form walls of said nozzle and diffuser slots and are separated by an annular groove (7) positioned in said end surface (6) and connected to at least one passage (9) forming together with the groove (7) said secondary channel, the diffuser slot height close to the groove (7) is larger than the nozzle slot height ($h_0$) close to the groove and decreasing in the shape of at least two bevels ($Z_1$ and $Z_2$) having bevel angles $\alpha_1$ and $\alpha_2$, the bevel angle $\alpha_1$, of one of said bevels ($Z_1$) closest to the groove being 8° to 15°, inclusive, and the angle $\alpha_2$ of another of the said bevels being 4° to 8°, inclusive, the ratio $\alpha_1/\alpha_2$ being from 1.25–3.25 and each bevel having a width of at least 0.5 times the smallest groove width, the diffuser slot height ($h_1$) being substantially constant and amounting to 0.84–0.97 times the nozzle slot height ($h_0$) close to the groove (7) along a distance of at least 0.8 times the smallest width of the groove (7) commencing at a distance of at most 4.9 times the smallest width of the groove (7) from the outermost edge of the nozzle (21).

2. The ejector pump of claim 1, wherein said nozzle slot height increases from the center towards the outmost edge of the nozzle along a conical surface having a bevel angle ($\alpha_4$) amounting to not more than 4°.

3. The ejector pump of claim 2, wherein said diffuser beyond the constant height ($h_1$) diffuser slot has a slot height increasing radially outwards along a conical surface having a bevel angle of 2°–6°.

4. The ejector pump of claim 1, wherein said diffuser beyond the constant height ($h_1$) diffuser slot has a slot height increasing radially outwards along a conical surface having a bevel angle of 2°–6°.

* * * * *

UNITED STATES PATENT AND TRADEMARK OFFICE

CERTIFICATE OF CORRECTION

PATENT NO. : 4,523,894

DATED : June 18, 1985

INVENTOR(S) : Lennart FORSLUND

It is certified that error appears in the above-identified patent and that said Letters Patent is hereby corrected as shown below:

On the initial page of the patent, in the ABSTRACT, line 19, after "angle of bevel" insert --$\alpha_2$--;

line 20, after "and each bevel" delete "$\alpha_2$".

Signed and Sealed this

*Eleventh* Day of *March 1986*

[SEAL]

*Attest:*

DONALD J. QUIGG

*Attesting Officer*

*Commissioner of Patents and Trademarks*